US005915318A

United States Patent [19]

Iwasaki et al.

[11] Patent Number: 5,915,318

[45] Date of Patent: Jun. 29, 1999

[54] WORK-SHEET FOLDING APPARATUS FOR POCKET SETTER

[75] Inventors: Toshiaki Iwasaki, Nagoya; Minoru Yamaguchi, Kariya; Yutaka Takagiwa, Nagoya, all of Japan

[73] Assignee: Brother Kogyo Kabushiki Kaisha, Nagoya, Japan

[21] Appl. No.: 09/020,905

[22] Filed: Feb. 9, 1998

[30] Foreign Application Priority Data

Feb. 24, 1997 [JP] Japan ..... 9-056822

[51] Int. Cl.[6] ..... D05B 35/04

[52] U.S. Cl. ..... 112/470.16; 112/114; 112/475.06; 112/475.09; 223/38

[58] Field of Search ..... 112/470.16, 470.07, 112/470.06, 470.14, 104, 113, 114, 475.06, 475.09, 147; 223/37, 38

[56] References Cited

U.S. PATENT DOCUMENTS 5,218,915 6/1993 Iwasaki et al. ..... 223/38 X
5,454,336 10/1995 Iwasaki ..... 112/470.16
5,611,468 3/1997 Schulze ..... 112/470.16 X

FOREIGN PATENT DOCUMENTS 3-103083 10/1991 Japan .

*Primary Examiner*—Peter Nerbun
*Attorney, Agent, or Firm*—Oliff & Berridge, PLC

[57] ABSTRACT

A work-sheet folding apparatus including a table having a hole; a support plate which is provided above the table and on which the work sheet is placed; a first folding member which cooperates with the support plate to fold an outer peripheral portion of the work sheet in a first direction perpendicular to the support plate; a first moving device which moves the first folding member in the first direction; second folding members which cooperate with the support plate to fold back the outer peripheral portion of the work sheet in a second direction parallel to the support plate; second moving devices which move the second folding members in the second direction; a support member which surrounds an outer peripheral portion of the support plate and which supports the second folding members; a pressing device which presses the support plate and the support member on the table; a movable member which is provided in the hole of the table such that the movable member is movable upward and downward; and a supporting device which supports the movable member such that an upper surface of the movable member is flush with an upper surface of the table, and which permits the movable member to be moved downward by being pressed by the folded-back outer peripheral portion of the work sheet when the support plate is pressed on the table by the pressing device.

25 Claims, 10 Drawing Sheets

WORK-SHEET FOLDING APPARATUS FOR POCKET SETTER

BACKGROUND OF THE INVENTION

1. Field of the Invention

The present invention generally relates to a work-sheet folding apparatus which includes a work-sheet support plate on which a work sheet is placed, and which folds an outer peripheral portion of the work sheet, and particularly to a work-sheet folding apparatus for a pocket setter which sets or forms a pocket.

2. Related Art Statement

There is known a pocket setter which folds an outer peripheral portion of a pocket-forming work sheet so as to have a shape corresponding to a pocket, and which automatically sews the thus folded work sheet to a base work sheet, such as a front body, to form the pocket in a predetermined area thereon.

For example, Japanese Utility Model Application laid open for inspection under Publication No. 3-103083 discloses a work-sheet folding system including a folding machine which folds an outer peripheral portion of a pocket-forming work sheet, and a sewing machine which sews the folded outer peripheral portion of the pocket-forming work sheet.

As shown in FIG. 3(*a*) to 3(*d*) of the above Japanese document, the pocket-forming work sheet P includes a hem portion 60 corresponding to an opening of a pocket. The hem portion 60 is reinforced by being folded back one or two times. The work sheet P also includes an outer peripheral portion 70. When the outer peripheral portion 70 is folded back by folding members 35, opposite end portions M of the peripheral portion 70 which correspond to opposite end portions of the hem portion 60 are additionally folded back by chamfering plates 55 to provide two "stacked" portions 80. Each of the stacked portion 80 consists of six layers or sheets in the case where the hem portion 60 is reinforced by being folded back one time, and consists of nine layers or sheets in the case where the hem portion 60 is reinforced by being folded back two times. In each case, each stacked portion 80 has a great thickness. Hence, a table 14 of the prior pocket setter has a recess 50 in a predetermined area corresponding to the hem portion 60 of the work sheet P. The recess 50 has a depth corresponding to the thickness of each stacked portion 80. Thus, the folding members 35 can be adjusted to take their positions lower by the depth of the recess than those taken by folding members of other known pocket setters. Since the folding members 35 and the chamfering plates 55 can be retracted away from the work sheet P without drawing out the stacked portions 80, the stacked portions 80 are kept intact without being deformed.

However, the depth of the recess 50 formed in the table 14 cannot be changed. Either a thick fabric such as denim or a thin fabric such as soft denim or silk may be used as the pocket sheet P and a front-body sheet to which the pocket sheet P is sewn to form a pocket thereon. In the case where the depth of the recess 50 is too great, stacked portions 80 of a thin work sheet cannot be appropriately pinched or pressed between the bottom of the recess 50 and a work-sheet support plate 24. In this case, the stacked portions 80 cannot be kept intact when the folding members 35 and the chamfering plates 55 are retracted away from the support plate 24. On the other hand, in the case where the depth of the recess 50 is too small, stacked portions 80 of a thick work sheet are pinched or pressed, with too great a pressure, between the bottom of the recess 50 and the support plate 24.

In this case, when the folding members 35 and the chamfering plates 55 are retracted away from the support plate 24, the stacked portions 80 are drawn out and cannot be kept intact, either.

The recess 50 includes an inclined portion 53 on the side of the sewing machine 11. When the work sheet P whose outer peripheral portion has been folded back by the folding machine is moved to a sewing position where the sewing machine 11 is provided, the stacked portions 80 of the work sheet P is likely to be out of shape, because the stacked portions 80 must climb up the inclined portion 53 of the recess 50. Even the shape of the work sheet P corresponding to the shape of the final pocket may be deformed.

SUMMARY OF THE INVENTION

It is therefore an object of the present invention to provide a work-sheet folding apparatus which can stably and accurately fold various sorts of work sheets having different thickness values.

It is another object of the present invention to provide a pocket setter including a work-sheet folding apparatus which can stably and accurately fold various sorts of work sheets having different thickness values, and a sewing machine which can sew a folded work sheet to a base work sheet at improved production efficiency.

It is another object of the present invention to provide a work-sheet folding process in which each work sheet can be folded in a shortened cycle time.

The present invention provides a work-sheet folding apparatus, a pocket setter, and a work-sheet folding method which have one or more of the technical features which are described below in respective paragraphs given parenthesized sequential numbers (1) to (25). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed.

(1) According to a first feature of the present invention, there is provided an apparatus for folding a work sheet, comprising a table having a hole; a work-sheet support plate which is provided above the table and on which the work sheet is placed; a first folding member which cooperates with the work-sheet support plate to sandwich the work sheet and fold an outer peripheral portion of the work sheet in a first direction substantially perpendicular to the support plate; a first-folding-member moving device which moves the first folding member relative to the work-sheet support plate in the first direction; a plurality of second folding members which cooperate with the work-sheet support plate to fold back the outer peripheral portion of the work sheet in a second direction substantially parallel to the support plate; a plurality of second-folding-member moving devices which move the plurality of second folding members, respectively, relative to the work-sheet support plate in the second direction; a second-folding-member support member which surrounds an outer peripheral portion of the work-sheet support plate and which supports the second folding members; a pressing device which presses at least the work-sheet support plate and the second-folding-member support member, on the table; a movable member which is provided in the hole of the table such that the movable member is movable upward and downward relative to the table; and a supporting device which supports the movable member such that an upper surface of the movable member is flush with an upper surface of the table, and which permits the movable member to be moved downward by being pressed by the folded-back outer peripheral portion of the work sheet when the work-sheet support plate is pressed on the table by the pressing device. The work sheet may be a pocket-forming work sheet including a hem portion corresponding to an opening of a pocket, and the hem portion may be reinforced by being folded back one or more times. In this case, when the outer peripheral portion of the pocket-forming work sheet is folded back by the cooperation of the work-sheet support plate and the first and second folding members, opposite end portions of the hem portion are folded back one or more times so as to provide two "stacked" portions each of which consists of a number of layers or sheets. When the second folding members are retracted away from the work-sheet support plate, the movable member is permitted to be moved downward by an amount corresponding to the total thickness of each stacked portion. Thus, the hem portion is appropriately pressed between the work-sheet support plate and the movable member. Therefore, the work-sheet support plate can be smoothly and quickly drawn out of the pocket-forming work sheet with a small resistance.

(2) According to a second feature of the present invention which includes the first feature (1), the supporting device comprises a biasing device which biases the movable member upward, and a stopping device which stops the upward movement of the movable member at a stop position thereof where the upper surface of the movable member is flush with the upper surface of the table. In the case where the movable member is provided by a sheet-spring member, the biasing device and the stopping device may be omitted.

(3) According to a third feature of the present invention which includes the second feature (2), the work-sheet folding apparatus further comprises an actuator which forcibly moves the movable member upward to the stop position thereof against the pressing of the folded-back outer peripheral portion of the work sheet. The actuator may comprise an air-operated cylinder device including a piston rod which presses the movable member upward. When the piston rod is extended to its uppermost position, the movable member is moved upward to just take its stop position where the upper surface of the movable member is flush with the upper surface of the table. The actuator is actuated, for example, when the work sheet whose outer peripheral portion has been folded back is moved to a sewing position. Since the movable member is forcedly moved upward to its stop position, the work sheet can be moved on the flush upper surfaces of the table and the movable member. Thus, the folded outer peripheral portion of the work sheet, and the overall shape of the work sheet corresponding to the shape of a pocket, are prevented from being out of shape.

(4) According to a fourth feature of the present invention which includes the second or third feature (2) or (3), the biasing device comprises biasing means for applying an adjustable biasing force to the movable member.

(5) According to a fifth feature of the present invention which includes the fourth feature (4), the biasing means comprises a plurality of spring members, and the biasing force of the biasing means is adjustable by removing at least one of the spring members from the apparatus. Alternatively, one or more of the spring members may be replaced by one or more spring members having a different spring constant. In this case, the biasing force of the biasing means can be adjusted to a value suitable for the sort of the work sheet being used.

(6) According to a sixth feature of the present invention which includes any one of the second to fifth features (2) to (5), the stopping device comprises a first engageable portion of the movable member and a second engageable portion of the table, and when the movable member is moved upward, the first engageable portion engages the second engageable portion so that the movable member is stopped at the stop position thereof. The first engageable portion of the movable member may be an integral portion of the movable member, or an engageable member fixed to the movable member. Likewise, the second engageable portion of the table may be an integral portion of the table, or an engageable member fixed to the table.

(7) According to a seventh feature of the present invention which includes the sixth feature (6), the first engageable portion of the movable member comprises an engageable member which is fixed to a lower surface of an end portion of the movable member and which extends over the end portion toward the second engageable portion of the table, and when the movable member is moved upward, the engageable member engages a lower surface of the second engageable portion of the table so that the movable member is stopped at the stop position thereof.

(8) According to an eighth feature of the present invention which includes the sixth or seventh feature (6) or (7), the stopping device further comprises a cushion member which is provided on one of the first and second engageable portions and which may butt on the other engageable portion.

(9) According to a ninth feature of the present invention which includes any of the second to eighth features (2) to (8), the supporting device further comprises an axis member which is supported by the table such that the axis member extends parallel to the upper surface of the table, and the movable member comprises a rotatable member which is rotatable about the axis member relative to the table.

(10) According to a tenth feature of the present invention which includes any of the first to ninth features (1) to (9), the supporting device comprises a sheet spring which is connected the table, and the sheet spring provides the movable member. The sheet spring may be fixed to a support member which in turn may be fixed to the table.

(11) According to an eleventh feature of the present invention which includes any of the first to tenth features (1) to (10), the table comprises a support portion, and wherein the supporting device comprises at least one spring member which is fixed, at one of opposite ends thereof, to the support portion of the table and is fixed, at the other end thereof, to the movable member, such that the spring member biases the movable member upward. The support portion of the table may be an integral portion of the table, or a support member fixed to the table. The at least one spring member may be one or more sheet springs which extend in a direction parallel to the upper surface of the table, or one or more coil springs which extend in a direction perpendicular to the upper surface of the table. The hole of the table may be a "straight" hole having a constant cross section, or a tapered hole. The movable member may be a "straight" movable member having a constant cross section, or a tapered movable member.

(12) According to a twelfth feature of the present invention which includes the eleventh feature (11), the hole of the table comprises a tapered hole whose cross-section area decreases in an upward direction and the movable member comprises a tapered movable member having a tapered shape corresponding to the tapered hole, and the at least one spring member cooperates with the tapered hole of the table to position the tapered movable member at a predetermined position relative to the table. In this case, the spring member also functions as a biasing device, and the tapered hole also functions as a stopping device.

(13) According to a thirteenth feature of the present invention which includes any one of the first to twelfth features (1) to (12), the work sheet comprises a pocket-forming work sheet including, in addition to the outer peripheral portion thereof, a hem portion which corresponds to an opening of a pocket and which has been folded back at least one time, wherein a base work sheet is placed on the table and the folded-back outer peripheral portion of the pocket-forming work sheet is pressed on the base work sheet, and wherein the apparatus further comprises a chamfering device comprising a plurality of third folding members which cooperate with the second folding members to fold back opposite end portions of the folded-back outer peripheral portion of the pocket-forming work sheet, respectively, which correspond to opposite end portions of the hem portion, respectively. The third folding members may be said as chamfering members. When the third folding members are retracted away from the work-sheet support plate, the movable member is moved downward by being pressed by the twice folded back portions (i.e. "stacked" portions) of the hem portion. Thus, the stacked portions of the hem portion are appropriately pressed between the work-sheet support plate and the movable member. Accordingly, the third folding members can be retracted away from the work-sheet support plate, without drawing out the stacked portions of the hem portion or deforming the folded-back portion of the pocket-forming work sheet. In addition, the height position of the third folding members can be adjusted by taking into account only their action for folding back the opposite end portions of the folded-back outer peripheral portion of the pocket-forming work sheet, but not their action for moving back away from the work-sheet support plate. Thus, the height position of the third folding members can be easily adjusted.

(14) According to a fourteenth feature of the present invention which includes any one of the first to thirteenth features (1) to (13), each of the third folding members comprises a rotatable folding member which is rotatable about an axis line substantially perpendicular to the work-sheet support plate, and wherein the chamfering device further comprises a plurality of actuators which rotate the rotatable folding members about the axis lines thereof, respectively. The second folding members are moved at a level between the work-sheet support plate and the third folding members.

(15) According to a fifteenth feature of the present invention which includes any one of the first to fourteenth features (1) to (14), the work-sheet folding apparatus further comprises a second-folding-member-support-member moving device which moves the second-folding-member support member relative to the work-sheet support plate in the first direction to an operative position thereof where the second-folding-member support member surrounds the outer peripheral portion of the work-sheet support plate.

(16) According to a sixteenth feature of the present invention which includes any one of the first to fifteenth features (1) to (15), the work-sheet folding apparatus further comprises a work-sheet-support-plate moving device which moves the work-sheet support plate in a third direction substantially parallel to the upper surface of the table.

(17) According to a seventeenth feature of the present invention which includes any one of the first to sixteenth features (1) to (16), the movable member has a cross-section shape corresponding to a cross-section shape of the hole of the table.

(18) According to an eighteenth feature of the present invention, there is provided a pocket setter comprising a work-sheet folding apparatus according to any one of the first to seventeenth features (1) to (17); and a sewing device which sews a pocket-forming work sheet as the work sheet whose outer peripheral portion has been folded back by the work-sheet folding apparatus, to a base work sheet, to form a pocket thereon. The present pocket setter enjoys the same advantages as the above-described advantages of the work-sheet folding apparatus according to any one of the first to seventeenth features (1) to (17). In addition, since the work-sheet support plate can be quickly drawn out of the pocket-forming work sheet, the pocket-forming work sheet can be sewn to the base work sheet in a reduced cycle time, which contributes to improving the production efficiency of the pocket setter.

(19) According to a nineteenth feature of the present invention which includes the eighteenth feature (18), the pocket setter further comprises a work-sheet moving device which moves the pocket-forming work sheet and the base work sheet, on the table, from the work-sheet folding apparatus to the sewing device.

(20) According to a twentieth feature of the present invention which includes the nineteenth feature (19), the work-sheet moving device comprises a feeding plate having a slot along which the sewing device forms stitches to fix the pocket-forming work sheet to the base work sheet; a feeding-plate pressing device which presses the feeding plate on the pocket-forming work sheet and the base work sheet; and a feeding-plate moving device which moves the feeding plate pressing the pocket-forming work sheet and the base work sheet on the table, from the work-sheet folding apparatus to the sewing device.

(21) According to a twenty-first feature of the present invention, there is provided a process of folding a work sheet, comprising the steps of placing a first work sheet on a table having a hole in which a movable member is provided such that an upper surface of the movable member is flush with an upper surface of the table, placing a second work sheet on a work-sheet support plate provided above the table, folding an outer peripheral portion of the work sheet in a first direction substantially perpendicular to the work-sheet support plate, folding back the outer peripheral portion of the work sheet in a second direction substantially parallel to the work-sheet support plate, and pressing the work-sheet support plate on the table, while supporting the movable member such that the movable member is permitted to be moved downward by being pressed by the first work sheet and the folded-back outer peripheral portion of the second work sheet under the support plate. The present process enjoys the same advantages as the above-described advantages of the work-sheet folding apparatus according to the first feature (1).

(22) According to a twenty-second feature of the present invention which includes the twenty-first feature (21), the work-sheet folding process further comprises a step of forcibly moving the movable member upward, against the pressing of the first work sheet and the folded-back outer peripheral portion of the second work sheet, so that the upper surface of the movable member becomes flush with the upper surface of the table.

(23) According to a twenty-third feature of the present invention which includes the twenty-first or twenty-second feature (21) or (22), the work-sheet folding process further comprises steps of: pressing, with a press plate, the first and second work sheets on the table, and drawing the work-sheet support plate from the second work sheet pressed with the press plate.

(24) According to a twenty-fourth feature of the present invention which includes the twenty-third feature (23), the work-sheet folding process further comprises a step of sewing the second work sheet to the first work sheet.

(25) According to a twenty-fifth feature of the present invention which includes the twenty-fourth feature (24), the work-sheet folding process further comprises a step of moving the press plate pressing the first and second work sheets on the table, to move the work sheets from a folding position where the second work sheet is folded back, to a sewing position where the second work sheet is sewn to the first work sheet.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
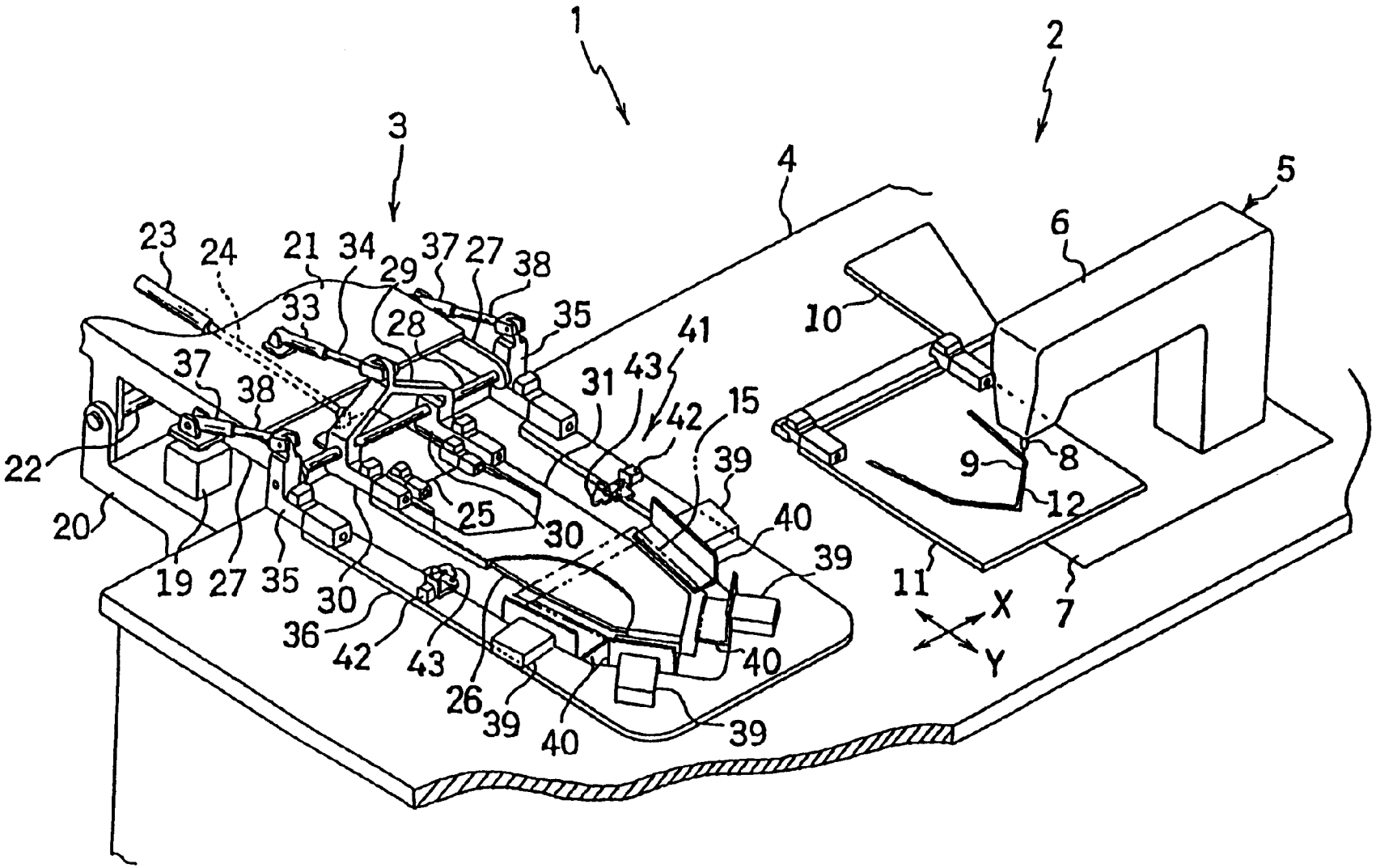
FIG. 1 is a perspective view of a pocket setter including a work-sheet folding machine to which the present invention is applied.

FIG. 1 shows a pocket setter 1 including a folding machine 3 to which the present invention is applied. The folding machine 3 folds an outer peripheral portion of a pocket-forming work sheet 15 (FIG. 5), such as a piece of cloth, a piece of fabric, or a piece of leather, which is cut out in advance. The pocket setter 1 additionally includes a sewing device 2 which sews the folded work sheet 15 to another work sheet, W, (FIG. 4) such as a front body of a garment. The pocket setter 1 also includes a table 4.

First, the sewing device 2 will be described.

The sewing device 2 includes a sewing machine 5 provided on the table 4. The sewing machine 5 includes an arm portion 6 and a bed portion 7. The arm portion 6 supports a needle bar 8 such that the needle bar 8 can vertically oscillate. A sewing needle 9 is attached to a lower end of the needle bar 8. The bed portion 7 includes a thread-loop catcher (not shown) which cooperates with the sewing needle 9 to form stitches on the two work sheets 15, W and thereby sew the work sheet 15 to the work sheet W so as to form a pocket on the front body.

A feeding arm 10 is provided on the table 4, such that the feeding arm 10 is movable in an X direction and a Y direction indicated by arrows in FIG. 1. A feeding plate 11 is detachably attached to the feeding arm 10. The feeding plate 11 has a generally V-shaped slit 12 corresponding to the outer peripheral portion of the work sheet 15 folded by the folding machine 3. The sewing needle 9 forms stitches on the work sheets 15, W along the slit 12 of the plate 11.

When the sewing machine 5 operates, the feeding arm 10 is vertically moved by about ten milimeters by an air-operated cylinder device (not shown) under control of a control device (not shown), so that the feeding plate 11 presses the work sheets 15, W against the table 4. The feeding arm 10 is also moved in the X and Y directions by a driving or moving device (not shown), under control of the control device according to sewing data, so that the sewing needle 9 forms stitches on the work sheets 15, W along the slit 12 of the feeding plate 11.

Referring next to FIGS. 1 to 4, there will be described the folding machine 3 which folds the outer peripheral portion of the work sheet 15.

The folding machine 3 includes an auxiliary table 20 which is fixed to a left half portion of the main table 4 such that an upper surface of the auxiliary table 20 is lower than that of the main table 4. A support member 21 is provided above the auxiliary table 20, and is supported by the auxiliary table 20 such that the support member 21 is rotatable or pivotable about an axis member 22 which is attached to the auxiliary table 20 so as to extend in the X direction. Thus, the support member 21 can take a horizontal position, as shown in FIG. 1, in which the support member 21 extends horizontally. An air-actuated cylinder device 19 includes a piston rod (not shown) connected to the support member 21, and can rotate or pivot the support member 21 between the horizontal position thereof and an upper, pivoted position thereof.

An air-actuated cylinder device 23 is fixed to a lower surface of the support member 21, such that a piston rod 24 of the cylinder device 23 extends in the Y direction. A front end of the piston rod 24 is connected to a rear end of a work-sheet support member 25 to which a work-sheet support plate 26 is detachably attached. A front portion of the support plate 26 has a shape which defines the shape of a pocket to be formed of the work sheet 15. When the piston rod 24 is advanced from, and retracted into, the housing of the air cylinder 23, the support plate 26 is moved in the Y direction via the support member 25.

Opposite ends of an axis member 28 are supported by a pair of support portions 27 projecting frontward from opposite ends of a front end portion of the support member 21. A folding-body support member 29 is supported by the axis member 28 such that the folding-body support member 29 is rotatable or pivotable about the axis member 28. The support member 29 includes a pair of support portions 30 to which a base portion of a work-sheet folding body 31 is detachably attached.

The folding body 31 includes a flange 31*a* (FIG. 6A) which projects downward from an outer periphery of a front portion of the folding body 31, along an outer periphery of the front portion of the support plate 26. An air-operated cylinder device 33 which is fixed to an upper surface of the support member 21 has a piston rod 34 which is rotatably connected to an upper, middle portion of the folding-body support member 29. When the piston rod 34 is advanced from, and retracted into, the housing of the air cylinder 33, the folding body 31 is rotated or pivoted, via the support member 29, between a generally horizontal, operative position thereof where the folding body 31 contacts the support plate 26 and an upper, pivoted, retracted position thereof.

A pair of support blocks 35 are rotatably supported by the opposite ends of the axis member 28, respectively. Each support block 35 is provided by a generally L-shaped member. Two base portions of a folding-member support body 36 are detachably attached to the two support blocks 35, respectively. The folding-member support body 36 is provided by a generally U-shaped member. Two air-operated cylinder devices 37 are rotatably fixed to opposite side surfaces of the support member 21, respectively. Each cylinder device 37 has a piston rod 38 which is rotatably connected to an upper end portion of a corresponding support block 35. When the piston rods 38 are advanced from, and retracted into, the housings of the air cylinders 37, respectively, the folding-member support body 36 is pivoted or rotated, via the support blocks 35, between a generally horizontal, operative position thereof and an upper, pivoted, retracted position thereof. The two air cylinders 37 function as a moving device which moves the folding-member support body 36.

Four air-operated cylinder devices 39 are fixed to an upper surface of a front half portion of the folding-member support body 36. The four air-operated cylinder devices 39 horizontally fold four portions of the outer peripheral portion of the work sheet 15, respectively. The four portions have been folded vertically downward by the flange 31*a* of the folding body 31. A folding member 40 which has a generally L-shaped cross section is fixed to a piston rod (not shown) of each of the four air cylinders 39. The four folding members 40 are oriented toward the work-sheet folding portion (i.e., front half portion) of the support plate 26. The air cylinders 39 function as moving devices which move the folding members 40, respectively.

Figure 3:
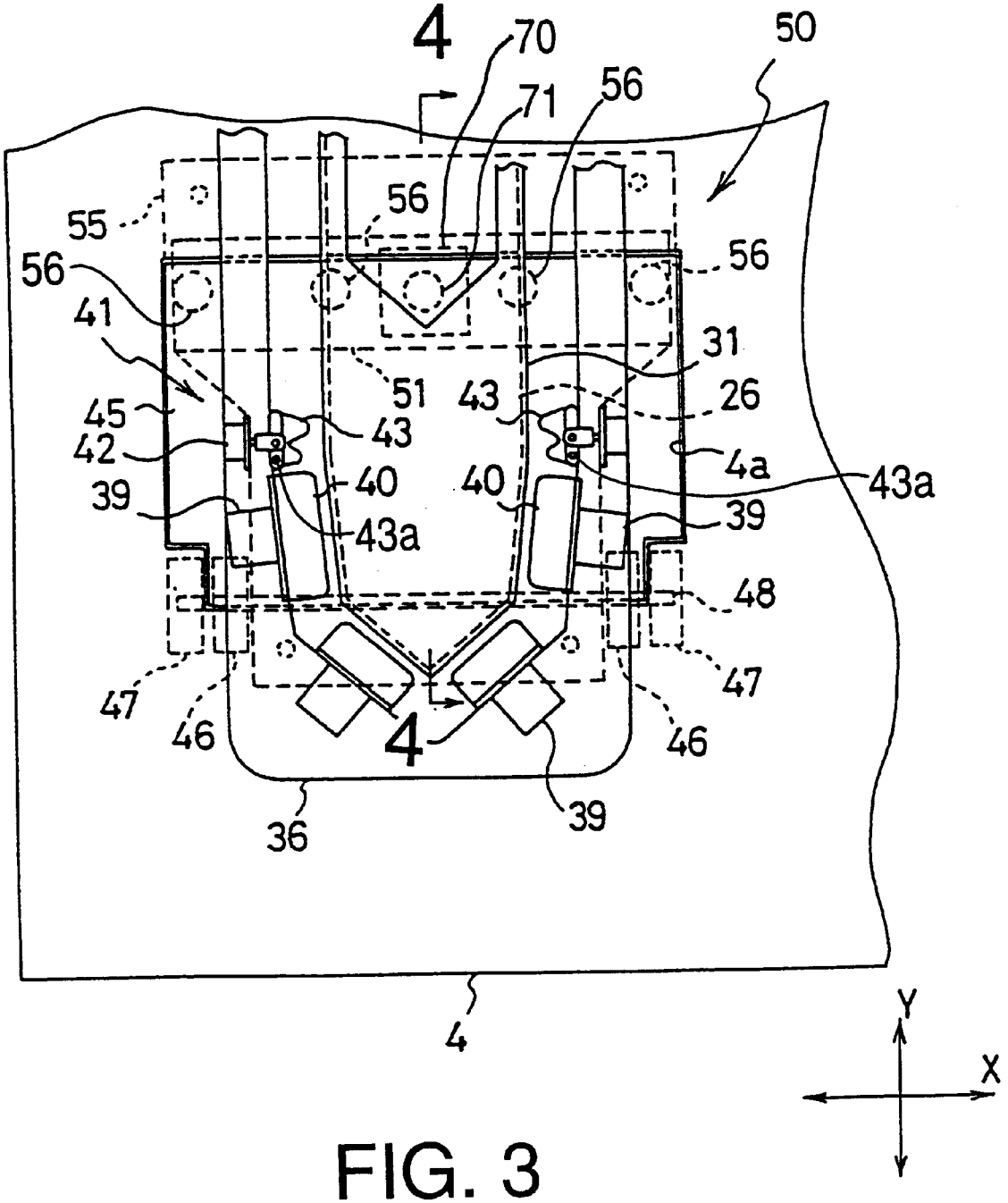
FIG. 3 is an enlarged, plan view of an important portion of the folding machine of FIG. 1.

On the upper surface of the folding-member support member 36, two chamfering devices 41 are provided. Each chamfering device 41 includes a chamfering plate 43, and an air-operated cylinder device 42 including a piston rod which is rotatably connected to the chamfering plate 43. When the piston rod of the air cylinder 42 is advanced or extended, the chamfering plate 43 is rotated about an axis member 43*a* (FIG. 3) which extends in a substantially vertical direction. When an outer peripheral portion of the pocket-forming work sheet 15 is folded by the four folding members 40, the chamfering plates 43 are rotated about the axis members 43*a* before the four folding members 40 are moved toward the work-sheet support plate 26. The two folding members 40 which are adjacent to the two chamfering plates 43 cooperate with those chamfering plates 43 to fold back opposite end portions of a hem portion 15*a* (described in detail later) of the work sheet 15 which corresponds to an opening of the pocket, in a manner as shown in FIG. 3(*d*) of the previously-identified Japanese document 3-103083. Thus, two "stacked" portions 15*c* (FIG. 8) corresponding to the "stacked" portions 80 shown in FIG. 3(*d*) of the Japanese document are formed.

Figure 5:
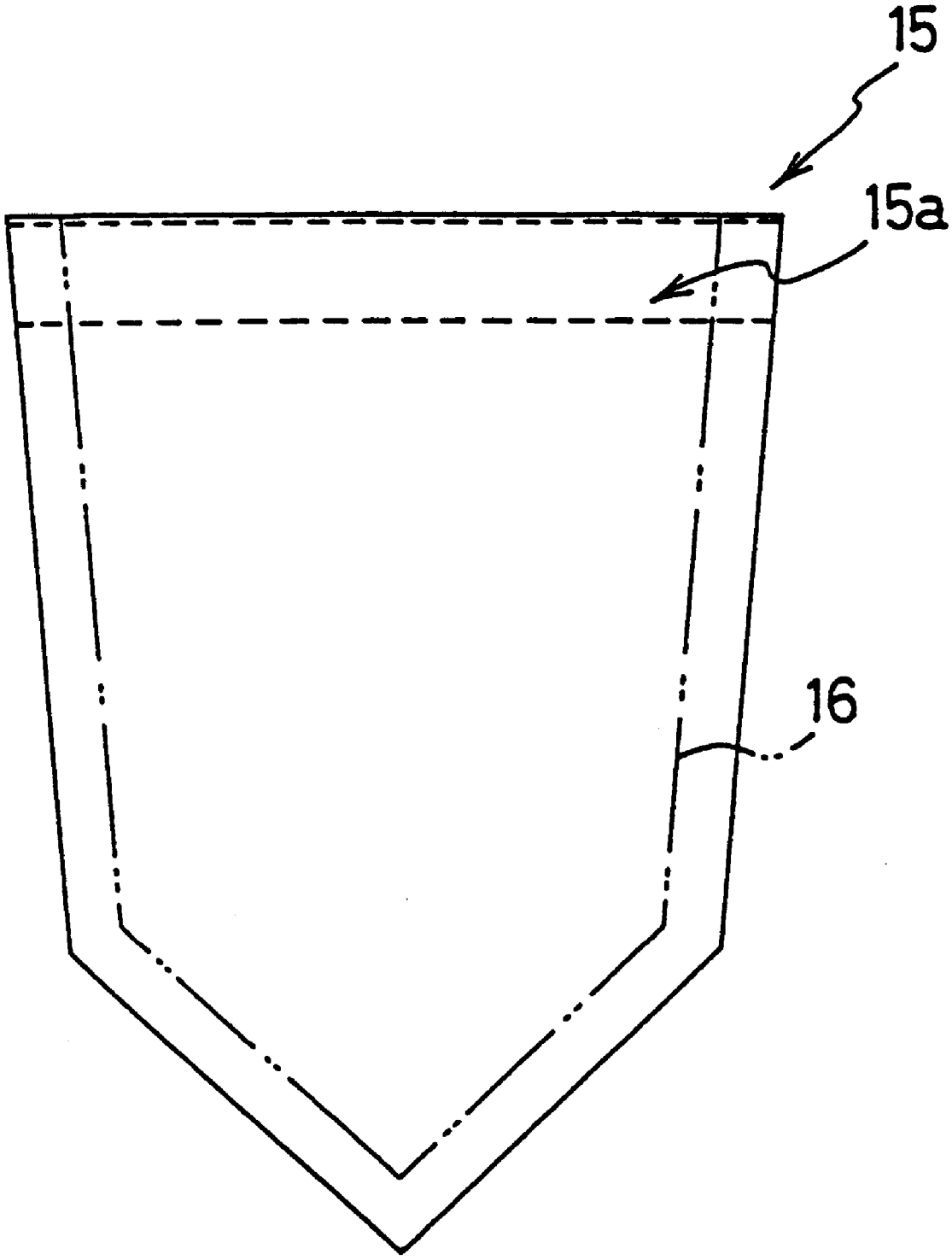
FIG. 5 is a plan view of a pocket-forming work sheet 15 whose outer peripheral portion is folded by the folding machine of FIG. 1.

Next, the pocket-forming work sheet 15 is briefly described by reference to FIG. 5. The work sheet 15 is cut out in advance so as to have a shape suitable for forming a pocket. The work sheet 15 includes a hem portion 15*a* corresponding to an opening of the pocket. The hem portion 15*a* is obtained by folding back, two times, an upper end portion of the work sheet 15, and sewing the thus reinforced upper end portion to fix the same. The thus obtained work sheet 15 is placed on the work-sheet support plate 26. Then, the outer peripheral portion of the work sheet 15 except the hem portion 15*a* is folded back one time along a folding line 16 indicated by a two-dot chain line in FIG. 5.

Figure 2:
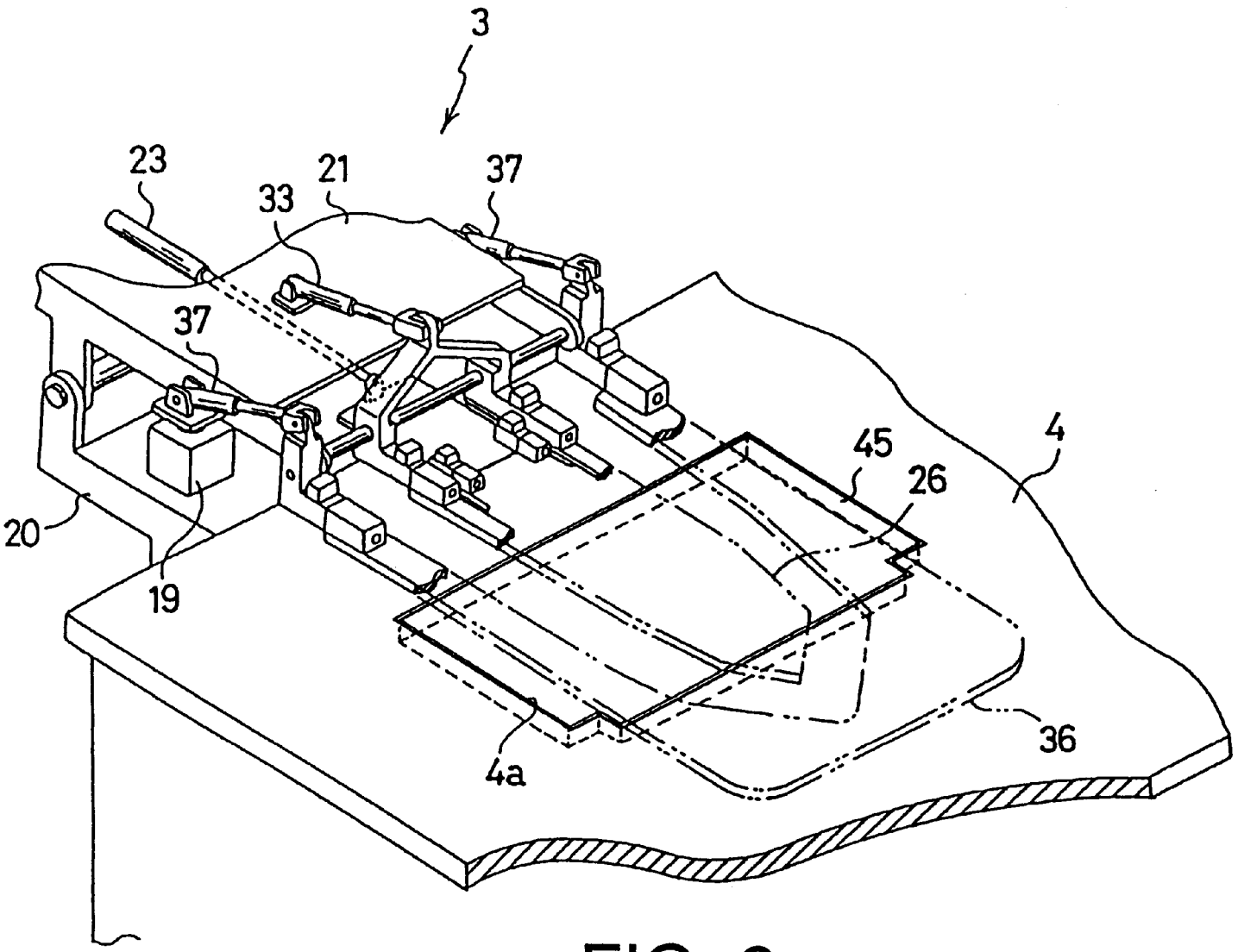
FIG. 2 is a partly cut away, perspective view of the folding machine of FIG. 1.
Figure 4:
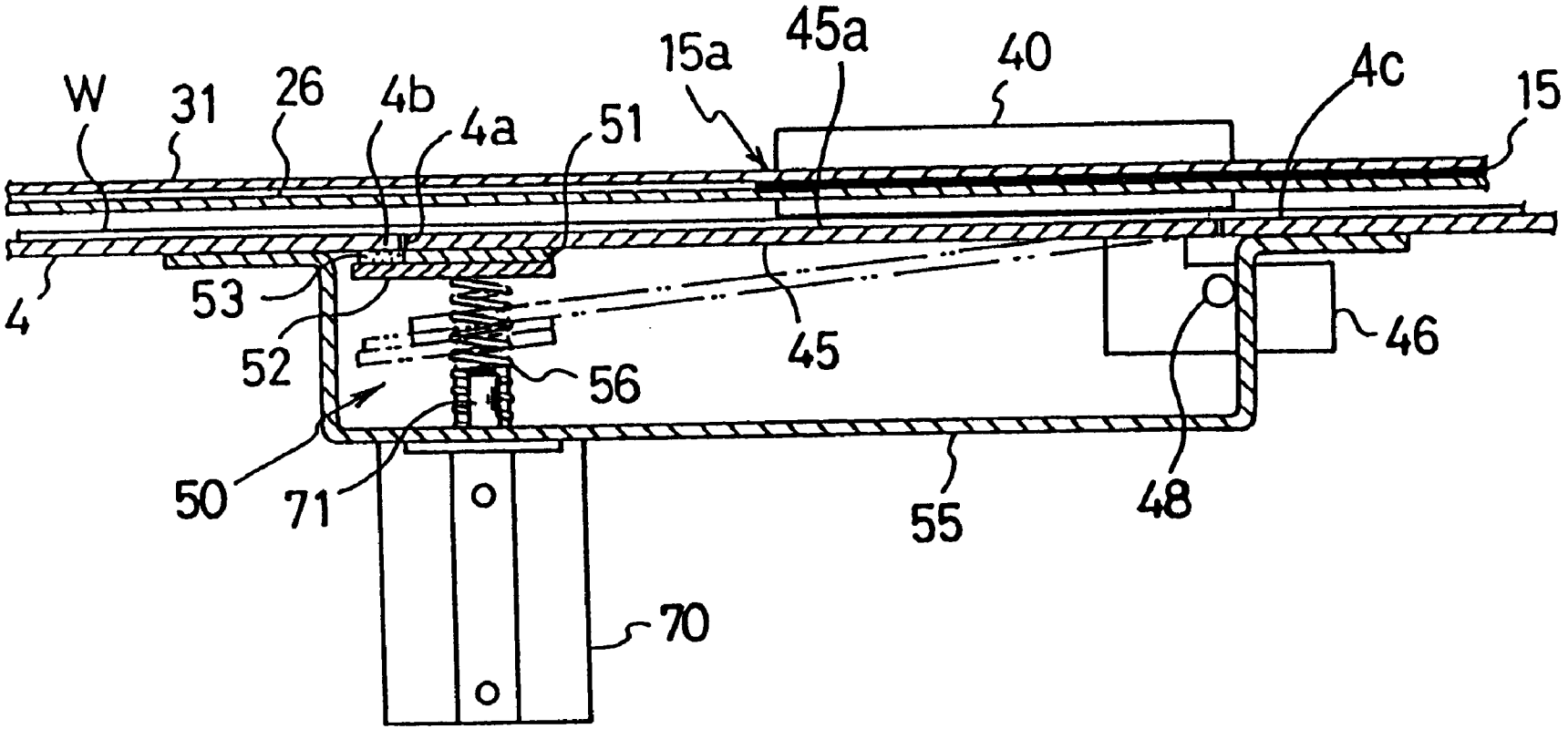
FIG. 4 is a cross-section view of the folding machine of FIG. 1, taken along line 4—4 in FIG. 3.

As shown in FIGS. 2 to 4, the table 4 has a generally rectangular hole or opening 4*a* in an area in which the hem portion 15*a* of the work sheet 15 is positioned. A movable member 45 which has a cross-section shape corresponding to that of the opening 4*a* is provided in the opening 4*a*. A pair of support plates 46 are fixed to a lower surface of the movable plate 45 at opposite ends of a front end portion of the same 45, respectively. In addition, another pair of support plates 47 are fixed to a lower surface of the table 4 at two positions outside the two support plates 46, respectively. The two pairs of support plates 46, 47 support an axis member 48 which extends in the X direction, i.e., parallel to the hem portion 15*a* of the work sheet 15. Thus, the movable member 45 is pivotable or rotatable about the axis member 48.

Referring next to FIGS. 3 and 4, there will be described a stopping device 50 which stops an upward rotation or movement of the movable member 45 such that an upper surface 45*a* of the movable member 45 is flush with an upper surface 4*c* of the table 4.

A spacer member 51 is fixed to a lower surface of a rear end portion of the movable member 45 over substantially the entire length of the rear end portion. An engagement plate 52 is fixed to a lower surface of the spacer member 51, such that the engagement plate 52 extends rearward from the rear end of the movable member 45. A cushion member 53 made of rubber is adhered to a rear portion of an upper surface of the engagement plate 52 which portion corresponds to an engagement portion 4*b* of the table 4. The cushion member 53 has a thickness substantially equal to that of the spacer member 51. When the movable member 45 is rotated upward, the cushion member 53 butts the lower surface of the engagement portion 4*b* of the table 4, so that the upper surface 45*a* of the movable member 45 becomes flush with that 4*c* of the table 4 without producing noise.

Thus, the stopping device 50 is provided by the spacer member 51, the engagement plate 52, the cushion member 53, and the engagement portion 4*b* of the table 4.

An auxiliary plate 55 is fixed to the lower surface of the table 4, so as to cover the engagement plate 52 and the opening 4*a* (i.e., the movable member 45). Four spring members 56 are provided in an array between the engagement plate 52 and the auxiliary plate 55, so as to apply a biasing force to bias the rear end portion of the movable member 45 upward and thereby make the respective upper surfaces 45*a*, 4*c* of the movable member 45 and the table 4 flush with each other. Thus, the spring members 56 and the auxiliary plate 55 cooperate with each other to provide a biasing device.

The biasing force of the biasing device 55, 56 is changeable by removing one or two spring members 56 from the four spring members 56 and/or changing the position or positions of one or two spring members 56 out of the four spring members 56. Thus, the biasing force of the biasing device 55, 56 is adjustable to an appropriate value depending upon the sort of the work sheet 15 in use, the thickness of the work sheet 15, and/or the number of the folded layers or sheets of each stacked portion 15*c* of the hem portion 15*a*.

An air-operated cylinder device 70 is fixed to the auxiliary plate 55 such that a piston rod 71 of the air cylinder 70 can be advanced upward from, and be retracted downward into, the housing of the same 70. When the piston rod 71 is advanced upward, the rod 71 pushes the engagement plate 52 and thereby rotates the movable member 45 upward. When the outer peripheral portion of the work sheet 15 is folded along the folding line 16 by the folding members 40, the movable member 45 is rotated downward since it is pushed downward by each stacked portion 15*c* of the hem portion 15*a*. In this state, the air cylinder 70 can be operated to advance the piston rod 71 upward and thereby forcibly rotate the movable member 45 upward to its horizontal position where the upper surface 45*a* of the movable member 45 is flush with that 4*c* of the table 4. Even if the engagement plate 52 may butt the engagement portion 4*b* of the table 4, the cushion member 53 would prevent noise.

Figure 6A:
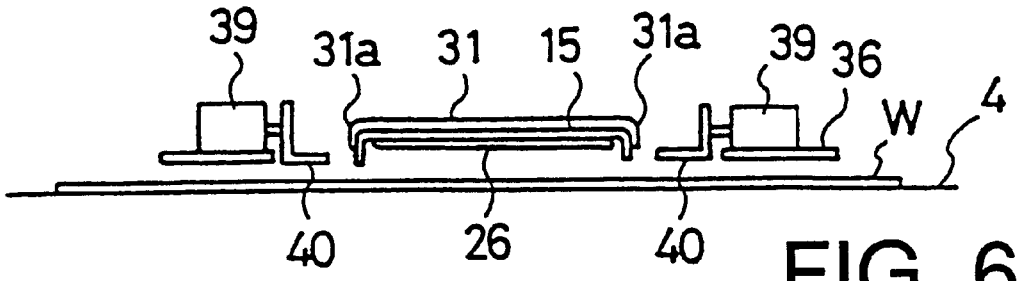
FIG. 6A is a view for explaining a step in which the work sheet 15 is folded downward by a folding body 31 and a support plate 26.

Hereinafter, there will be described the operation of the work-sheet folding machine 3 constructed as described above. First, as shown in FIG. 6A, the pocket-forming work sheet 15 is placed on the support plate 26. In this state, the air cylinder 33 is operated to rotate the folding body 31 downward so that the folding body 31 cooperates with the support plate 26 to sandwich the first work sheet 15 and the flange 31*a* of the folding body 31 folds downward the outer peripheral portion of the work sheet 31 except the hem portion 15*a*, along the folding line 16, i.e., along the outer periphery of the front portion of the support plate 26. The second work sheet W is placed on the table 4 including the movable member 45.

Figure 6B:
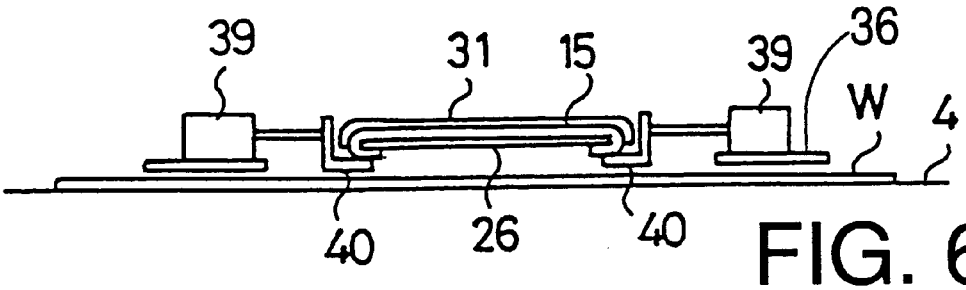
FIG. 6B is a view for explaining a step in which the work sheet 15 is folded horizontally by folding members 40 and the support plate 26.

Then, as shown in FIG. 6B, the air cylinders 39 are operated to advance the folding members 40 to their operative positions in the vicinity of the support plate 26, where the folding members 40 horizontally fold the outer peripheral portion of the first work sheet 15, so that the outer peripheral portion of the first work sheet 15 is folded back onto the lower surface of the support plate 26.

Figure 8:
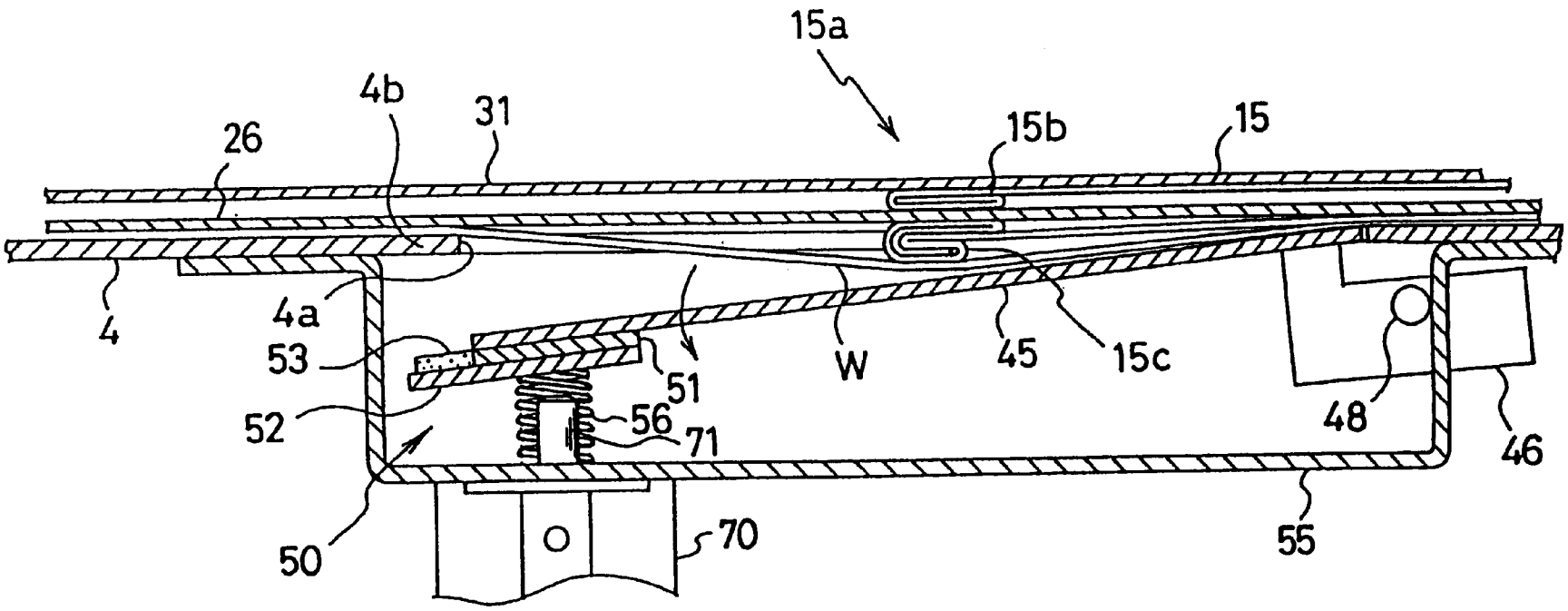
FIG. 8 is a view corresponding to FIG. 4, showing a state in which a movable member 45 is moved downward by being rotated downward from its uppermost position where the movable member 45 is aligned with the table 4.

In this state, two upper end portions of the outer peripheral portion of the work sheet 15 which correspond to opposite end portions of the hem portion 15*a* are simultaneously folded back two times by the cooperation of the two folding members 40 and the two chamfering plates 43, as described above. Thus, as shown in FIG. 8, the hem portion 15*a* includes a first folded portion 15*b* which is obtained in advance by folding back two times the upper end portion of the original pocket-forming work sheet 15 and which is supported on the upper surface of the support plate 26, and two second folded (i.e., "stacked") portions 15*c* each of which is obtained by folding back two times the two-time folded-back hem portion 15*a* with the chamfering devices 41 and each of which is positioned under the support plate 26. The first folded portion 15*b* consists of three sheets or layers of the work sheet 15, and each second folded portion 15*c* consists of six sheets of the work sheet 15. The first folded portion 15*b* overlaps the two second folded portions 15*c*, at opposite end portions of the hem portion 15*a*, respectively, each of which therefore consists of nine sheets of the work sheet 15. The work sheet 15 with the hem portion 15*a* is placed on the second work sheet W. Thus, the ten sheets 15, W in total are stacked on one another on the table 4.

Figure 6C:
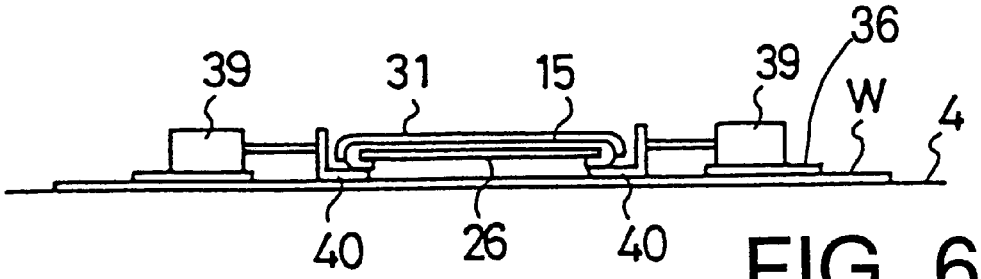
FIG. 6C is a view for explaining a step in which the work sheet 15 is pressed on another work sheet, W, on a table 4.

Next, as shown in FIG. 6C, the air cylinder 19 is operated to retract its piston rod into its housing, so that the support member 21 is rotated downward. Accordingly, the support plate 26, the folding body 31, and the folding-member support body 36 are moved downward until the support body 36 and the folding members 40 contact the upper surface of the second work sheet W.

Figure 7A:
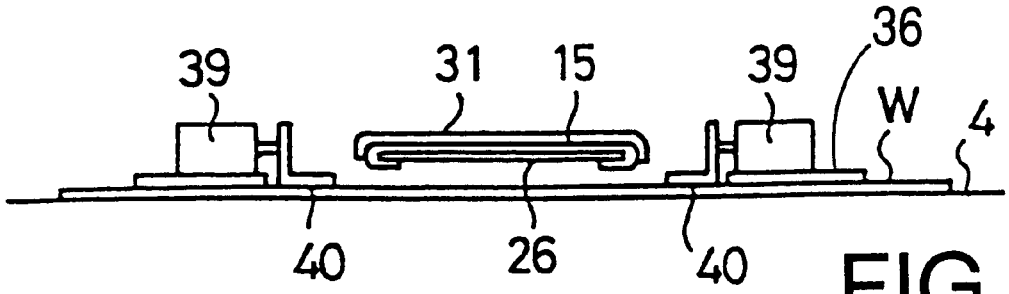
FIG. 7A is a view for explaining a step in which the folding members 40 are retracted away from the support plate 26.

Next, as shown in FIG. 7A, the air cylinders 39 are operated to retract their piston rods into their housings, so that the folding members 40 are retracted to their retracted positions away from the outer periphery of the front portion of the support plate 26. Since the air cylinder 19 is being operated to rotate the support plate 26 downward, each second folded portion 15*c* of the hem portion 15*a* of the work sheet 15, i.e., the six folded sheets 15*c* (FIG. 8) are pushed downward under the support plate 26, so that the movable member 45 is rotated downward against the biasing force of the spring members 56.

More specifically described, the movable member 45 is moved downward by an amount corresponding to the thickness of each second folded portion 15*c*, i.e., the number of the folded layers of each second folded portion 15*c*. Thus, each second folded portion 15*c* is pressed back with an appropriate force by the spring members 56 via the movable member 45. In this state, the air cylinders 42 are operated to retract their piston rods into their housings, so that the chamfering plates 43 are retracted to their retracted positions away from the outer periphery of the support plate 26. When the chamfering plates 43 are retracted away from the support plate 26, the second folded portions 15*c* folded back by the chamfering plates 43 are not drawn out together with the chamfering plates 43 being rotated, because the second folded portions 15*c* are appropriately pressed by the movable member 45, that is, are not pressed with an excessively great force. Thus, the second folded portions 15*c* are kept intact without being deformed. In addition, the height position of the chamfering plates 43 can be adjusted by taking into account only their action for folding back the opposite end portions of the hem portion 15*a* of the pocket-forming work sheet 15, but need not take into account their action for retracting away from the work-sheet support plate 26. Thus, the height position of the chamfering plates 43 can be easily adjusted.

Figure 7B:
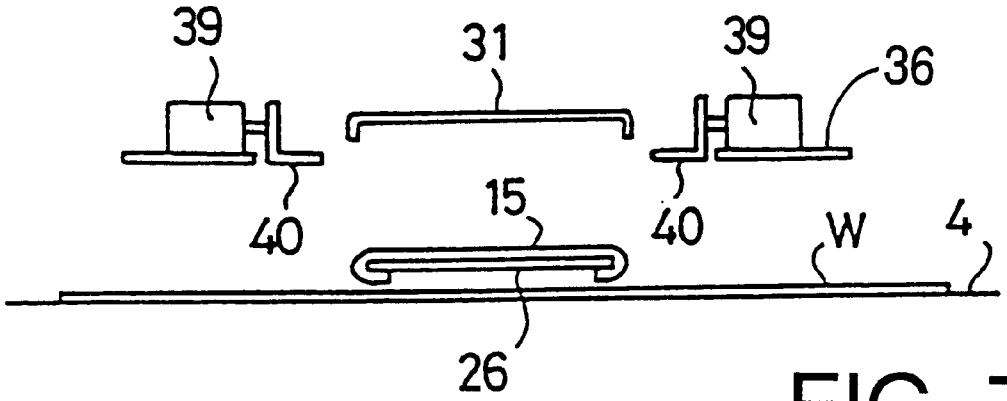
FIG. 7B is a view for explaining a step in which the folding body 31 is retracted away from the support plate 26.

Subsequently, as shown in FIG. 7B, the air cylinders 33, 37 are operated to retract their piston rods 34, 38 into their housings, so that the folding body 31 and the folding-member support body 36 are rotated upward to their retracted positions. In addition, the feeding plate 11 is moved to a predetermined position above the support plate 26, where the feeding plate 11 is pressed on the first work sheet 15 and the support plate 26. Then, the air cylinder 23 is operated to move the support plate 26 rearward, so that the support plate 26 is drawn out of the first work sheet 15. In this state, the movable member 45 is taking its retracted, lower position downwardly away from its upper, horizontal position by an angle corresponding to the number of folded layers of each second folded portion 15*c* of the hem portion 15*a* of the work sheet 15, and accordingly each second folded portion 15*c* is not pressed with an excessively great force. Therefore, an excessively great resistance is not exerted to the support plate 26, when the support plate 26 is drawn out of the work sheet 15. Thus, the support plate 26 is quickly drawn out, which contributes to shortening a cycle time at which the pocket setter 1 folds each first work sheet 15 and sews each first work sheet 15 to each second work sheet W.

Next, as shown in FIG. 4, the air cylinder 70 is operated to advance its piston rod 71 upward, so that the movable member 45 is forcedly rotated upward. This upward rotation or movement of the movable member 45 is stopped at its upper, horizontal position by the stopping device 50, so that the upper surface 45*a* of the movable member 45 becomes flush with that 4*c* of the table 4. Then, the first and second work sheets 15, W are moved to the sewing machine 2 by the feeding plate 11, while being pressed on the table 4 by the same 11. The sewing device 5 sews the first work sheet 15 to the second work sheet W so as to provide a pocket on the sheet W. Since the movable member 45 is forcedly moved to its horizontal position flush with the table 4, the two work sheets 15, W are moved on the horizontal upper surfaces 45*a*, 4*c* of the movable member 45 and the table 4. Therefore, all the folded portions of the work sheet 15 including the hem portion 15*a* are kept intact, and a good pocket is formed of the work sheet 15 on the front body of the garment.

Figure 9:
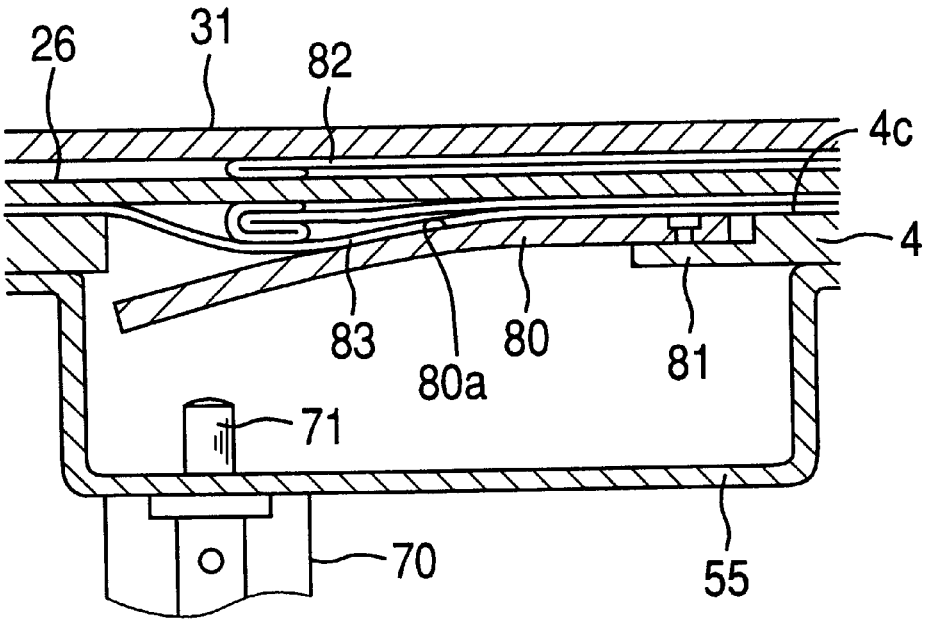
FIG. 9 is a view corresponding to FIG. 8, showing a state in which a sheet spring 80 as a movable member of another work-sheet folding apparatus as a second embodiment of the present invention is moved downward by being deformed downward from its uppermost position where the sheet spring 80 is aligned with the table 4.

Referring next to FIG. 9, there will be described a second embodiment of the present invention, which also relates to a work-sheet folding machine. The same reference numerals as used in the first embodiment shown in FIGS. 1 to 8 are used to designate the corresponding elements and parts of the second embodiment. The following description of the second embodiment only relates to the differences between the first and second embodiments.

In the second embodiment, the folding machine includes a sheet spring 80 in place of the movable member 45. The sheet spring 80 is fixed, at its front end portion, to a support portion 81 of the table 4 with screws. The sheet spring 80 may be replaced with another sheet spring having a different spring constant. In the present embodiment, a hem portion of a pocket-forming work sheet 82 is reinforced by being folded one time, and this work sheet 82 is sewn to another work sheet 83. When the piston rod 71 of the air cylinder 70 is advanced to its uppermost position, an upper surface 80*a* of the sheet spring 80 becomes flush with an upper surface 4*c* of the table 4.

In the second embodiment, too, opposite end portions of the hem portion of the first work sheet 82 are simultaneously folded back two times by the cooperation of the folding members 40 and the chamfering plates 43, like in the first embodiment. Thus, two "stacked" portions each of which consists of four layers or sheets are pinched or pressed between the work-sheet support plate 26 and the sheet spring 80. However, the sheet spring 80 is deformed downward by being pushed by each stacked portion of the hem portion of the first work sheet 82, and the second work sheet 83. Thus, each stacked portion is pressed with an appropriate force, and the support plate 26 is smoothly drawn out of the first work sheet 82.

Figure 10:
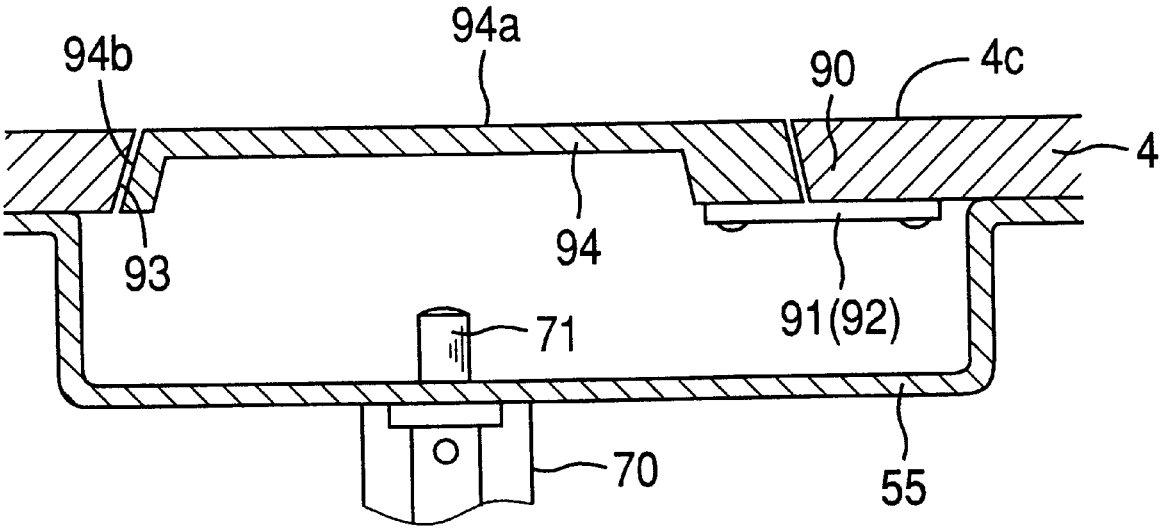
FIG. 10 is a view corresponding to FIG. 4, showing a state in which a movable member 94 of another work-sheet folding apparatus as a third embodiment of the present invention takes its uppermost position where the movable member 94 is aligned with the table 4.

Referring next to FIG. 10, there will be described a third embodiment of the present invention, which also relates to a work-sheet folding machine. The same reference numerals as used in the first embodiment shown in FIGS. 1 to 8 are used to designate the corresponding elements and parts of the third embodiment. The following description of the third embodiment only relates to the differences between the first and third embodiments.

In the third embodiment, the folding machine includes a movable member 94 in place of the movable member 45 of the first embodiment. The movable member 94 is connected to a support portion 90 of the table 4 via two elongate sheet springs 91, 92 (only one sheet spring 91 is shown in FIG. 10) which extend parallel to each other. The table 4 has a tapered hole 93 whose cross section decreases in an upward direction. The movable member 94 has a tapered outer circumferential surface 94*b* having a cross-section shape corresponding to that of the tapered hole 93. In a normal state, an upper surface 94*a* of the movable member 94 is flush with the upper surface 4*c* of the table 4 because of a biasing action of the sheet springs 91, 92. In the present embodiment, the air cylinder 70 is provided at a position corresponding to the center of the movable member 94.

In the third embodiment, too, opposite end portions of a hem portion of a pocket-forming work sheet (not shown) are simultaneously folded back two times by the cooperation of the folding members 40 and the chamfering plates 43, like in the first embodiment. Thus, two "stacked" portions each of which consists of six or four sheets are pinched or pressed between the work-sheet support plate 26 and the movable member 94. However, the sheet springs 91, 92 are deformed downward by being pushed by each stacked portion of the hem portion of the pocket-forming work sheet, and a base work sheet. Thus, each stacked portion is pressed with an appropriate force, and the support plate 26 is smoothly drawn out of the pocket-forming work sheet.

When the piston rod 71 of the air cylinder 70 is advanced upward to its uppermost position, the tapered hole 93 guides the upward movement of the movable member 94, so that the upper surface 94*a* of the movable member 94 can easily become flush with the upper surface 4*c* of the table 4. In addition, the tapered hole 93 cooperates with the sheet springs 91, 92 to position the movable member 94 in directions parallel to the upper surface 4*c* of the table 4. In the third embodiment, the movable member 94 is not rotated, but is translated, relative to the table 4.

The sheet springs 91, 92 may be replaced by one or more (e.g., three) coil springs which are provided between a lower surface of the movable member 94 and an upper surface of the auxiliary support member 55, such that each coil spring is fixed at one end thereof to the movable member 94 and is fixed at the other end thereof to the support member 55. In this modified case, the support member 55 functions like the support portion 90 of the table 4 in the third embodiment.

Figure 11:
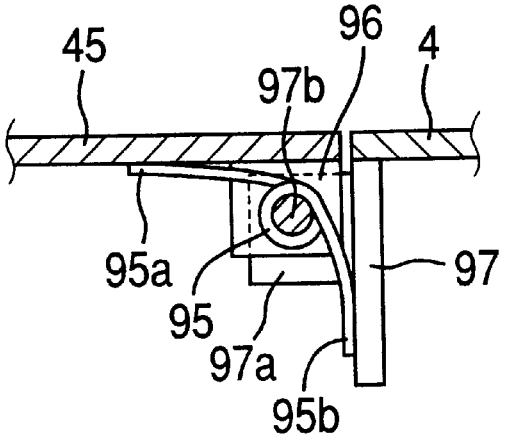
FIG. 11 is a view of another work-sheet folding apparatus as a fourth embodiment of the invention.

Referring next to FIG. 11, there will be described a fourth embodiment of the present invention. The present embodiment is basically similar to the first work-sheet folding machine 3 shown in FIG. 1, but is different from the first machine 3 in that the present machine has two torsion springs 95 (only one spring 95 is shown) which are provided between a movable member 45 and a table 4. Each torsion spring 96 fits on an axis portion 97*b* which horizontally extends from a support portion 97*a* of a first support member 97 which is fixed to a lower surface of the table 4. A second support member 96 which is fixed to a lower surface of the movable member 45 also fits on the axis portion 97*b*. Opposite end portions 95*a*, 95*b* of each torsion spring 95 are engaged with the lower surface of the movable member 45 and a side surface of the first support member 97. The torsion springs 95 bias the movable member 45 upward, like the springs 56 of the first machine 3 which are not employed in the present embodiment.

Figure 12:
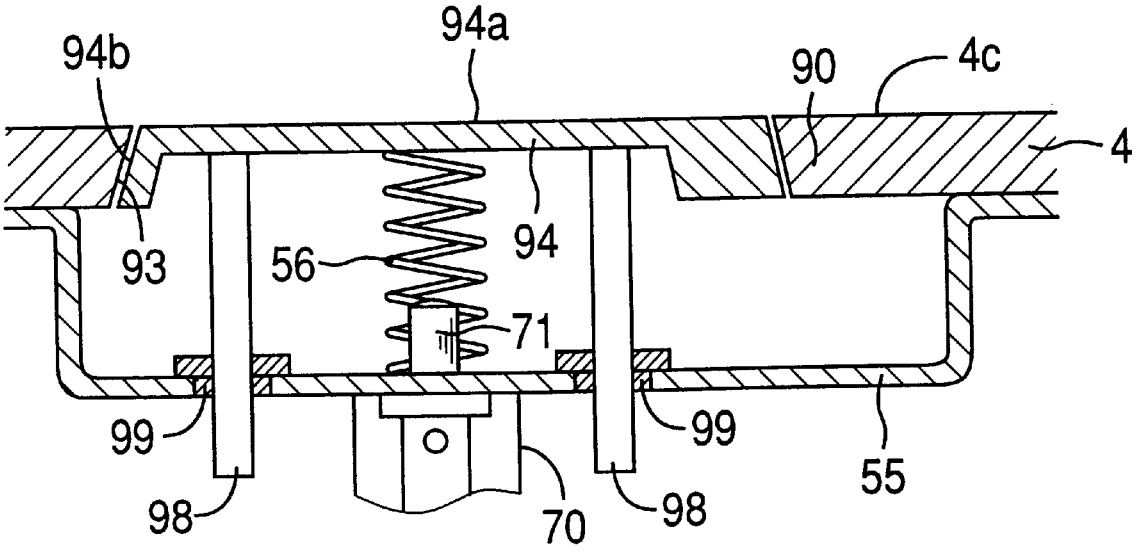
FIG. 12 is a view of another work-sheet folding apparatus as a fifth embodiment of the invention.

Referring next to FIG. 12, there will be described a fifth embodiment of the present invention. The present embodiment is basically similar to the third work-sheet folding machine shown in FIG. 10, but is different from the third machine in that the present machine has three guide bars 98 (only two bars 98 are shown) which extend vertically downward from a lower surface of a movable member 94 and each of which is guided by a metal sleeve 99, but does not employ the sheet springs 91, 92 used in the third machine. In this case, the movable member 94 is vertically movable while maintaining its upper surface 94*a* parallel to an upper surface 4*c* of a table 4.

While the present invention has been described in its preferred embodiments, the present invention may otherwise be embodied.

For example, the stopping device 50 may be provided by one or more pins, or one or more engagement members, which project from the portion 4*b* of the table 4, and the engagement plate 52. In this case, the rear end portion of the engagement plate 52 engages the pins or engagement members, so that the movable member 45 is stopped at its upper horizontal position.

In addition, the spring members 56 and the air-actuated cylinder device 70 may be replaced by an air-actuated cylinder device which includes (a) an air-pressure chamber which is normally communicated with the atmosphere, (b) a piston rod which is normally biased upward by a spring provided in the air-pressure chamber, and (c) a solenoid-operated valve which is switchable to an operative position where the valve allows a pressurized air to be supplied to the air-pressure chamber so that the piston rod is forcedly moved upward.

It is to be understood that the present invention may be embodied with other changes, improvements, and modifications that may occur to the person skilled in the art without departing from the scope and spirit of the invention defined in the appended claims.

What is claimed is:

1. An apparatus for folding a work sheet, comprising:

a table having a hole;

a work-sheet support plate which is provided above the table and on which the work sheet is placed;

a first folding member which cooperates with the work-sheet support plate to sandwich the work sheet and fold an outer peripheral portion of the work sheet in a first direction substantially perpendicular to the support plate;

a first-folding-member moving device which moves the first folding member relative to the work-sheet support plate in the first direction;

a plurality of second folding members which cooperate with the work-sheet support plate to fold back the outer peripheral portion of the work sheet in a second direction substantially parallel to the support plate;

a plurality of second-folding-member moving devices which move the plurality of second folding members, respectively, relative to the work-sheet support plate in the second direction;

a second-folding-member support member which surrounds an outer peripheral portion of the work-sheet support plate and which supports the second folding members;

a pressing device which presses at least the work-sheet support plate and the second-folding-member support member, on the table;

a movable member which is provided in the hole of the table such that the movable member is movable upward and downward relative to the table; and a supporting device which supports the movable member such that an upper surface of the movable member is flush with an upper surface of the table, and which permits the movable member to be moved downward by being pressed by the folded-back outer peripheral portion of the work sheet when the work-sheet support plate is pressed on the table by the pressing device.

2. An apparatus according to claim 1, wherein the supporting device comprises a biasing device which biases the movable member upward, and a stopping device which stops the upward movement of the movable member at a stop position thereof where the upper surface of the movable member is flush with the upper surface of the table.

3. An apparatus according to claim 2, further comprising an actuator which forcibly moves the movable member upward to the stop position thereof against the pressing of the folded-back outer peripheral portion of the work sheet.

4. An apparatus according to claim 2, wherein the biasing device comprises biasing means for applying an adjustable biasing force to the movable member.

5. An apparatus according to claim 4, wherein the biasing means comprises a plurality of spring members, and wherein the biasing force of the biasing means is adjustable by removing at least one of the spring members from the apparatus.

6. An apparatus according to claim 2, wherein the stopping device comprises a first engageable portion of the movable member and a second engageable portion of the table, and wherein when the movable member is moved upward, the first engageable portion engages the second engageable portion so that the movable member is stopped at the stop position thereof.

7. An apparatus according to claim 6, wherein the first engageable portion of the movable member comprises an engageable member which is fixed to a lower surface of an end portion of the movable member and which extends over said end portion toward the second engageable portion of the table, and wherein when the movable member is moved upward, the engageable member engages a lower surface of the second engageable portion of the table so that the movable member is stopped at the stop position thereof.

8. An apparatus according to claim 6, wherein the stopping device further comprises a cushion member which is provided on one of the first and second engageable portions and which may butt on the other engageable portion.

9. An apparatus according to claim 2, wherein the supporting device further comprises an axis member which is supported by the table such that the axis member extends parallel to the upper surface of the table, and wherein the movable member comprises a rotatable member which is rotatable about the axis member relative to the table.

10. An apparatus according to claim 1, wherein the supporting device comprises a sheet spring which is connected the table, and wherein the sheet spring provides the movable member.

11. An apparatus according to claim 1, wherein the table comprises a support portion, and wherein the supporting device comprises at least one spring member which is fixed, at one of opposite ends thereof, to the support portion of the table and is fixed, at the other end thereof, to the movable member, such that the spring member biases the movable member upward.

12. An apparatus according to claim 11, wherein the hole of the table comprises a tapered hole whose cross-section area decreases in an upward direction and the movable member comprises a tapered movable member having a tapered shape corresponding to the tapered hole, and wherein the at least one spring member cooperates with the tapered hole of the table to position the tapered movable member at a predetermined position relative to the table.

13. An apparatus according to claim 1, wherein the work sheet comprises a pocket-forming work sheet including, in addition to the outer peripheral portion thereof, a hem portion which corresponds to an opening of a pocket and which has been folded back at least one time, wherein a base work sheet is placed on the table and the folded-back outer peripheral portion of the pocket-forming work sheet is pressed on the base work sheet, and wherein the apparatus further comprises a chamfering device comprising a plurality of third folding members which cooperate with the second folding members to fold back opposite end portions of the folded-back outer peripheral portion of the pocket-forming work sheet, respectively, which correspond to opposite end portions of the hem portion, respectively.

14. An apparatus according to claim 13, wherein each of the third folding members comprises a rotatable folding member which is rotatable about an axis line substantially perpendicular to the work-sheet support plate, and wherein the chamfering device further comprises a plurality of actuators which rotate the rotatable folding members about the axis lines thereof, respectively.

15. An apparatus according to claim 1, further comprising a second-folding-member support member moving device which moves the second-folding-member support member relative to the work-sheet support plate in the first direction to an operative position thereof where the second-folding-member support member surrounds the outer peripheral portion of the work-sheet support plate.

16. An apparatus according to claim 1, further comprising a work-sheet-support-plate moving device which moves the work-sheet support plate in a third direction substantially parallel to the upper surface of the table.

17. An apparatus according to claim 1, wherein the movable member has a cross-section shape corresponding to a cross-section shape of the hole of the table.

18. A pocket setter comprising:

a work-sheet folding apparatus according to claim 1; and a sewing device which sews a pocket-forming work sheet as the work sheet whose outer peripheral portion has been folded back by the work-sheet folding apparatus, to a base work sheet, to form a pocket thereon.

19. A pocket setter according to claim 18, further comprising a work-sheet moving device which moves the pocket-forming work sheet and the base work sheet, on the table, from the work-sheet folding apparatus to the sewing device.

20. A pocket setter according to claim 19, wherein the work-sheet moving device comprises a feeding plate having a slot along which the sewing device forms stitches to fix the pocket-forming work sheet to the base work sheet; a feeding-plate pressing device which presses the feeding plate on the pocket-forming work sheet and the base work sheet; and a feeding-plate moving device which moves the feeding plate pressing the pocket-forming work sheet and the base work sheet on the table, from the work-sheet folding apparatus to the sewing device.

21. A process of folding a work sheet, comprising the steps of:

placing a first work sheet on a table having a hole in which a movable member is provided such that an upper surface of the movable member is flush with an upper surface of the table, placing a second work sheet on a work-sheet support plate provided above the table, folding an outer peripheral portion of the work sheet in a first direction substantially perpendicular to the work-sheet support plate, folding back the outer peripheral portion of the work sheet in a second direction substantially parallel to the work-sheet support plate, and pressing the work-sheet support plate on the table, while supporting the movable member such that the movable member is permitted to be moved downward by being pressed by the first work sheet and the folded-back outer peripheral portion of the second work sheet under the support plate.

22. A process according to claim 21, further comprising a step of forcibly moving the movable member upward, against the pressing of the first work sheet and the folded-back outer peripheral portion of the second work sheet, so that the upper surface of the movable member becomes flush with the upper surface of the table.

23. A process according to claim 21, further comprising steps of:

pressing, with a press plate, the first and second work sheets on the table, and drawing the work-sheet support plate from the second work sheet pressed with the press plate.

24. A process according to claim 23, further comprising a step of sewing the second work sheet to the first work sheet.

25. A process according to claim 24, further comprising a step of moving the press plate pressing the first and second work sheets on the table, to move the work sheets from a folding position where the second work sheet is folded back, to a sewing position where the second work sheet is sewn to the first work sheet.

* * * * *